US012644666B1

(12) United States Patent
Valerio

(10) Patent No.: US 12,644,666 B1
(45) Date of Patent: Jun. 2, 2026

(54) GRENADE LAUNCHER ATTACHMENT FOR RIFLES

(71) Applicant: Teodoro Valerio, Montrose, CO (US)

(72) Inventor: Teodoro Valerio, Montrose, CO (US)

( * ) Notice: Subject to any disclaimer, the term of this patent is extended or adjusted under 35 U.S.C. 154(b) by 0 days.

(21) Appl. No.: 19/183,104

(22) Filed: Apr. 18, 2025

(51) Int. Cl.
*F41C 27/06* (2006.01)
*F41A 3/58* (2006.01)

(52) U.S. Cl.
CPC ..... *F41C 27/06* (2013.01); *F41A 3/58* (2013.01)

(58) Field of Classification Search
CPC ..... F41C 27/06; F41A 3/58
USPC ..... 42/105
See application file for complete search history.

(56) References Cited

U.S. PATENT DOCUMENTS

| | | | | |
|---|---|---|---|---|
| 4,733,489 | A | 3/1988 | Kurak | |
| 5,930,935 | A | 8/1999 | Griffin | |
| 8,991,091 | B2 | 3/2015 | Griffin | |
| 10,234,222 | B2 * | 3/2019 | Couce | F41A 15/06 |
| 10,578,396 | B2 | 3/2020 | Teetzel et al. | |

* cited by examiner

*Primary Examiner* — Reginald S Tillman, Jr.
(74) *Attorney, Agent, or Firm* — Harpman & Harpman

(57) ABSTRACT

A projectile launcher attachment adapted for a standard unmodified firearm receiver capable of launching a variety of projectiles including flare, smoke round, and gas and less lethal projectiles. The launcher attachment is easily installed having a barrel breach release for loading and unloading rounds using the existing firearm receiver magazine release and provides a single shot break down barrel configuration utilizing the existing firearm attachment pin as a pivot point. A unique firing pin and firing control mechanism is interengaged with the existing firearm trigger and firearm hammer for integral select operation.

6 Claims, 6 Drawing Sheets

GRENADE LAUNCHER ATTACHMENT FOR RIFLES

BACKGROUND OF THE INVENTION

1. Technical Field

The present invention relates to firearms or specifically to grenade launchers that are adapted for use on such weapons. The preferred embodiment of the invention comprises a launcher apparatus adapted primarily for AR 15 as an interchangeable receiver.

There are a variety of firearm attachments to enable grenade launching using existing firearms such as an AR 15 rifle. There are also stand-alone launchers that have been developed for single purpose of launching large projectiles. There is a need for an adaptable launcher that can be readily fitted to the lower receiver of an AR 15 firearm providing a launcher with a firing pin and cocking assembly interengaged with the existing trigger and fire hammer mechanism.

2. Prior Art

Examples of such prior art devices can be seen in U.S. Pat. Nos. 4,733,489, 5,930,935, 9,991,019 and 10,578,396.

In U.S. Pat. No. 4,733,489, an apparatus to reconfigure an automatic rifle to include a grenade launcher having a mounting bracket secured to the weapon barrel and suspending a grenade launcher there below.

U.S. Pat. No. 5,930,935 claims a method and apparatus to attach a grenade launcher to a rifle having an interior assembly attached to the weapon providing an attachment mount to the grenade launcher there below the barrel.

U.S. Pat. No. 6,134,823 sets forth a device for attaching a supplemental device to a firearm such as a grenade launcher by a mounting bracket on the forward end of the rifle barrel with a grenade launcher attachment there below with its independent firing trigger assembly.

U.S. Pat. No. 8,991,091 illustrates and describes a universal launching system in kit form having a launching device pistol grip frame and stalk assembly. It functions as an independent grenade launcher.

Finally, in U.S. Pat. No. 10,578,396, a modular grenade launcher system is disclosed having an upper chassis and a lower chassis secured on opposite sides of the barrel of a weapon such as a firearm. A separate modular removable firing mechanism is provided for independent multiple grenade launching barrel assemblies can share a common firing mechanism.

SUMMARY OF THE INVENTION

The present invention is a grenade launcher assembly adapted for an AR15 type firearm lower base receiver independently by replacing the upper AR15 standard receiver. The launcher has a hinge barrel breach and a firing pin assembly for engagement by the standard AR15 hammer and trigger release. A cocking handle and arm engages the standard AR15 hammer and trigger assembly for firing. A dual locking and release pivot pin assembly provides for rapid assembly and use on a standard AR15 lower receiver assembly.

DETAILED DESCRIPTION OF THE INVENTION

Figure 1:
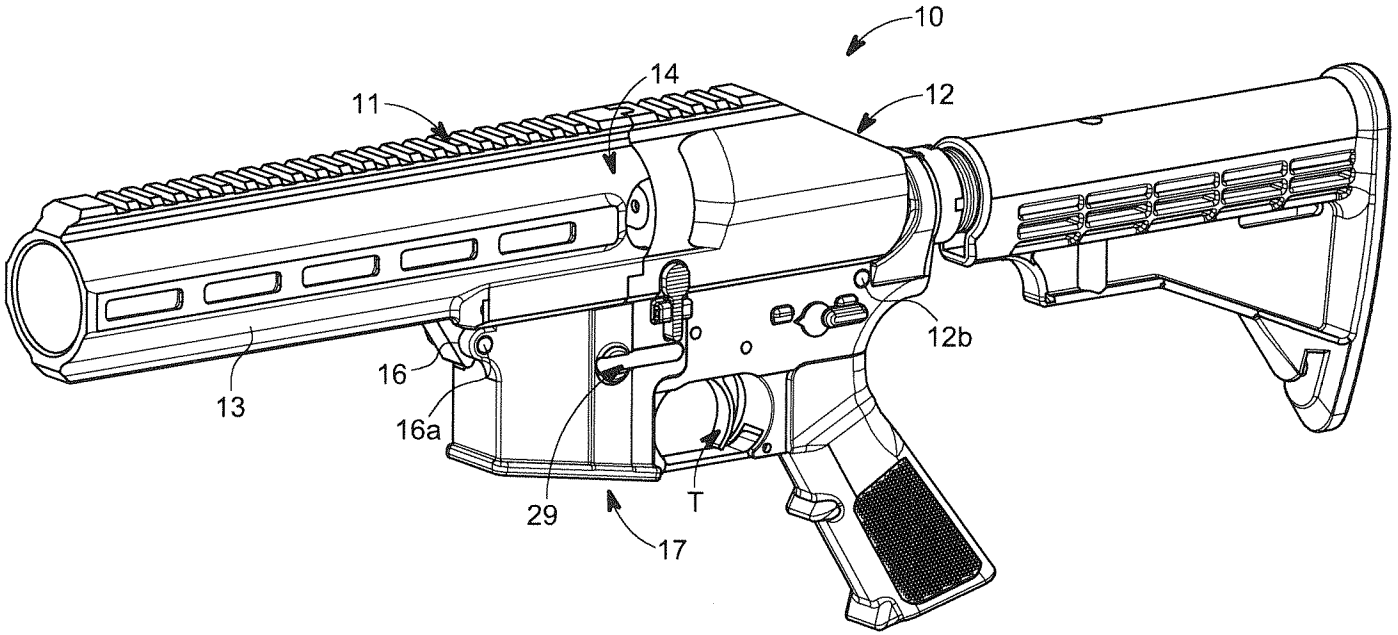
FIG. 1 is a top side and front perspective view of the grenade launcher mounted on an AR15 lower receiver.
Figure 2:
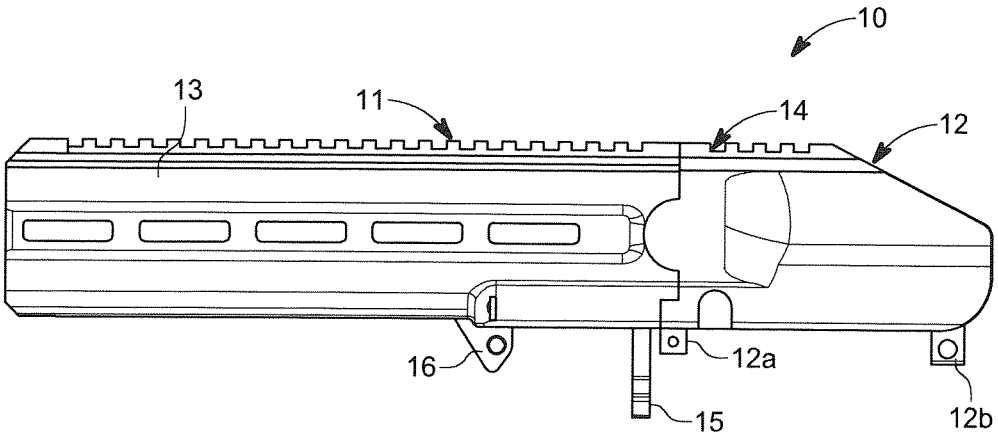
FIG. 2 is a front elevational view of the grenade launcher attachment.
Figure 3:
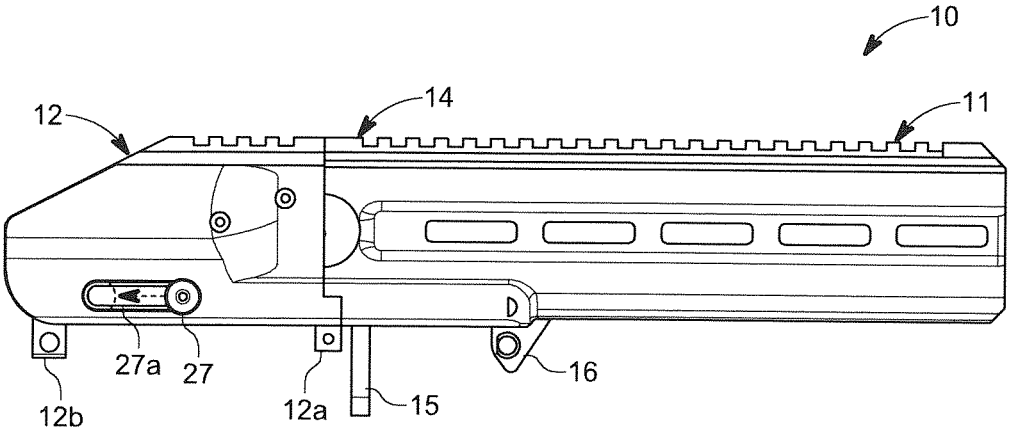
FIG. 3 is a rear elevational view of the grenade launcher attachment.
Figure 4:
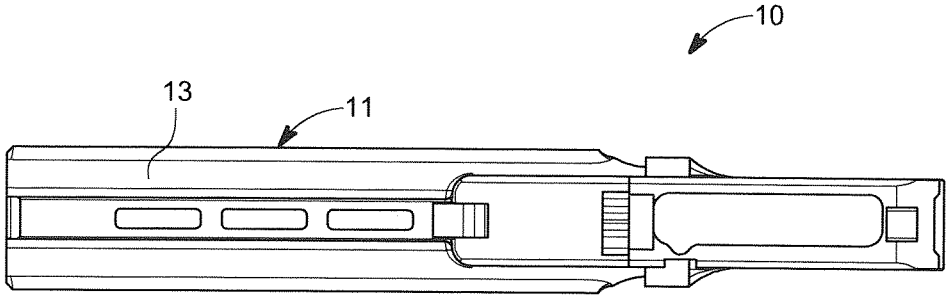
FIG. 4 is a bottom plan view thereof.

Referring now to FIGS. 1-8 of the drawings, a projectile launcher attachment 10 of the invention can be seen having a pivoting barrel assembly 11 and an upper receiver firing pin and hammer assembly 12. The barrel assembly 11 has a barrel 13 with a breach portion 14 and a depending latch release 15. A pivot pin registration lug 16 extends from the barrel breach portion 14 providing a barrel attachment to an AR15 lower receiver assembly 17 via a pivot pin 16A, best seen in FIGS. 1 and 8 of the drawings.

Correspondingly, the firing pin and hammer assembly 12 is removably secured to the AR15 lower receiver assembly 17 by a pair of apertured engagement retainment lugs 12A and 12B depending therefrom.

Figure 7:
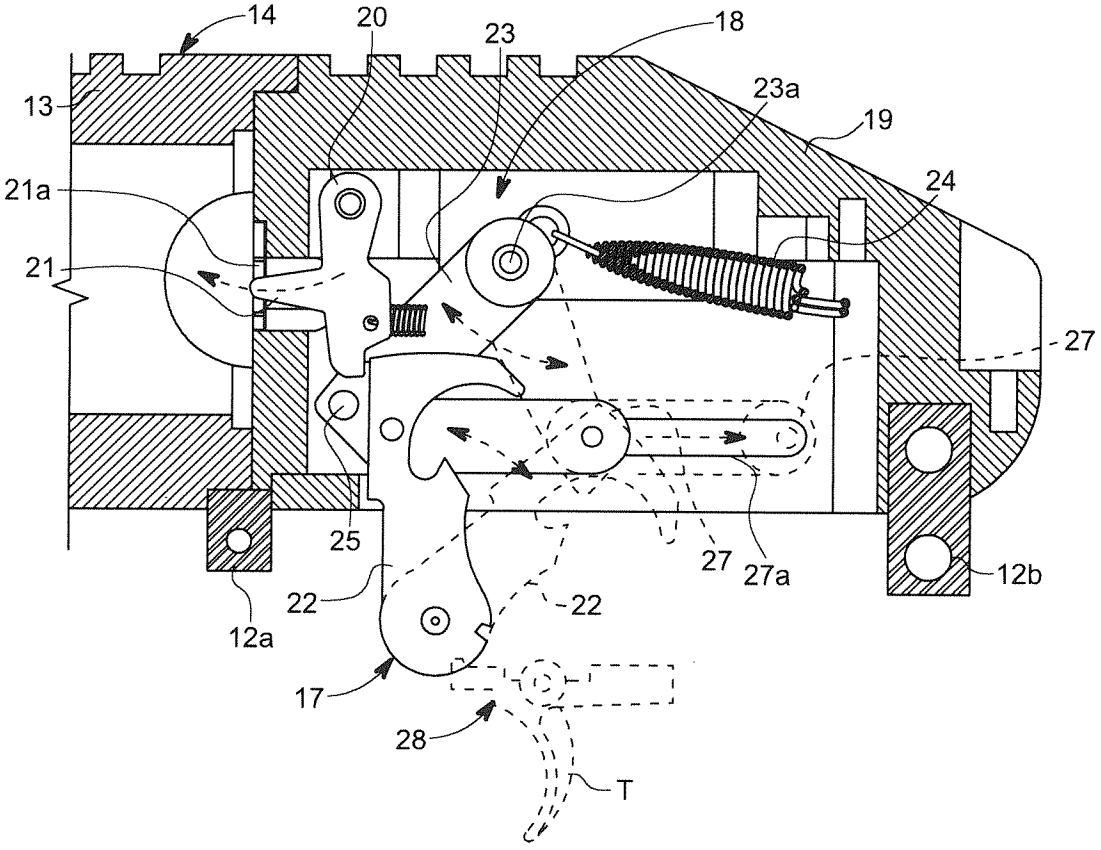
FIG. 7 is an enlarged sectional front elevational view of the firing pin assembly of the grenade launcher attachment.
Figure 8:
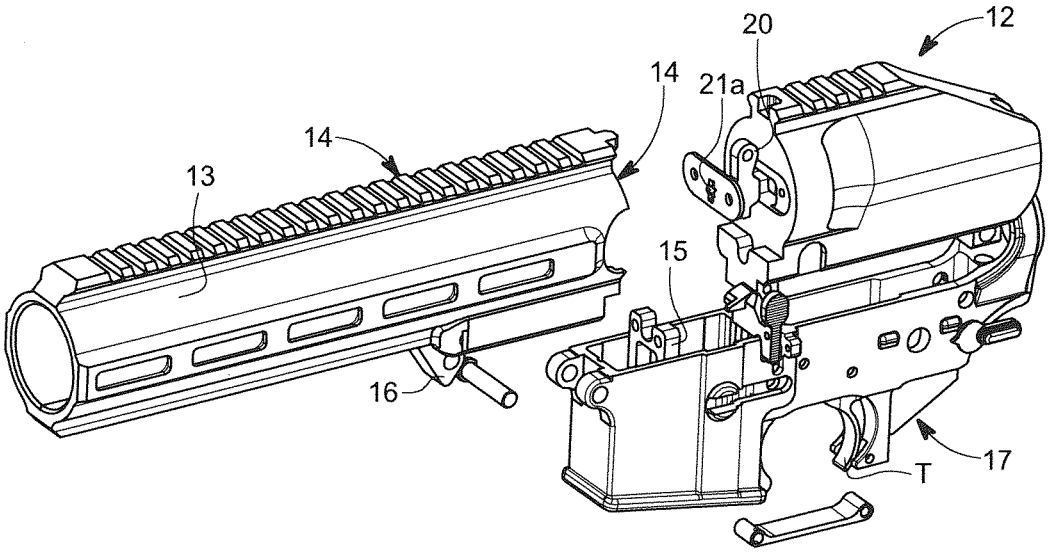
FIG. 8 is a partial perspective exploded view of the grenade launcher assembly positioned on a lower receiver.

Referring now to FIG. 7 of the drawings, the upper receiver firing pin and hammer cocking assembly 18 mounted in a housing 19 of the launcher body. A firing pin arm 20 has a firing pin extension 21 which is aligned with an access opening 21A in the housing 19 to the barrel breach portion 14.

The firing pin arm 20 is pivotally secured at its end to the housing 19 allowing the firing pin arm 20 and firing pin extension 21 to move when struck by a standard AR15 hammer 22 upon release, as will be described in greater detail hereinafter.

A cocking arm 23 of the assembly is provided that is pivotally secured at 23A with a return spring 24 extending therefrom. A hammer engagement pin 25 extends at right angle from the cocking arm 23 for selective engagement with the AR15 standard hammer 22. A cocking handle arm 26 is pivotally secured to the free end of the cocking arm 23 with a cocking handle 27 thereon for user engagement.

The standard AR15 hammer 22 by default is spring loaded, not shown, a standard AR15 trigger release assembly 28, shown in broken lines, until a trigger T is engaged by the user as will be understood by those skilled in the art.

It will be evident from the above description that the projectile launcher attachment 10 of the invention is selectively positioned on the standard AR15 receiver lower assembly 17 thereby providing a stand-alone independent projectile grenade launcher utilizing the trigger assembly 28 of the standard AR15 lower receiver assembly 17 which is well known in the art.

In operation, the cocking handle 27 is pulled back along a slide opening 27A against the spring 24 of the interconnected cocking arm 23 thereby with the cocking hammer 22 retained by the standard AR15 trigger assembly 17, shown in broken lines in FIG. 7 of the drawings.

It will be evident from the above description that once the hammer 22 is cocked the cocking arm 23 will then return under the spring 24 tension clear of the standard AR15 hammer 22 when released.

To fire the projectile launcher assembly 10 of the invention once, the trigger T of the standard AR15 lower receiver assembly 17 is pulled releasing the hammer 22 which will in turn strike the pivoting fire pin arm 20 driving the firing pin projection 21 through the opening 21A striking the projectile round, not shown, within the barrel breach portion 14.

Figure 6:
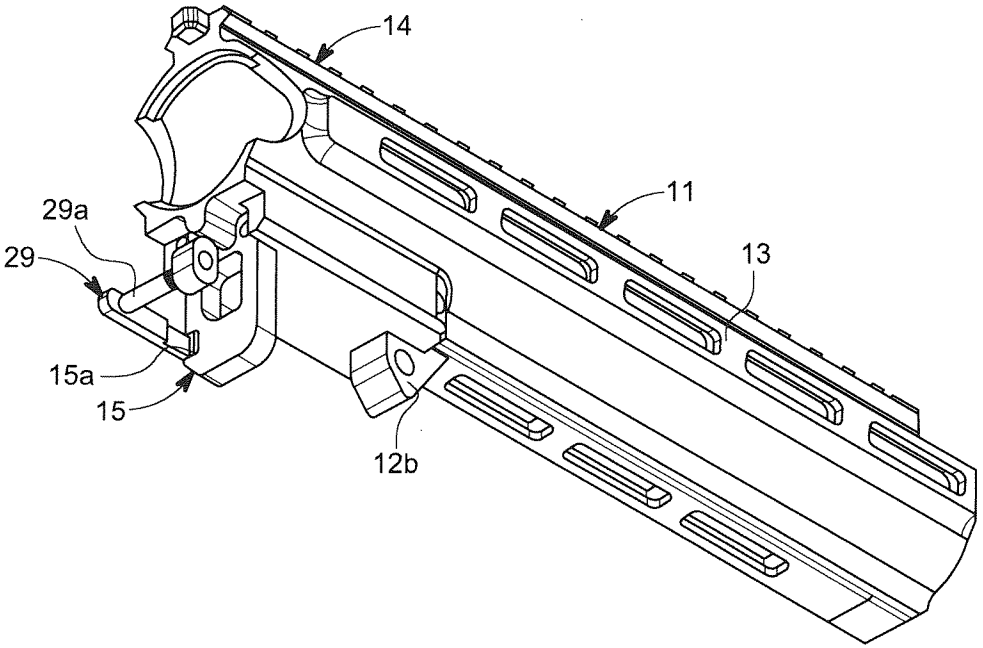
FIG. 6 is a perspective bottom view of the barrel portion of the grenade launcher attachment.

Referring to FIG. 6 of the drawings, an AR15 standard magazine release assembly 29 is indicated for retained engagement and release of the barrel assembly 12. The barrel latch release 15 has a magazine release engagement shoulder 15A formed on a corresponding recess therein.

Figure 5:
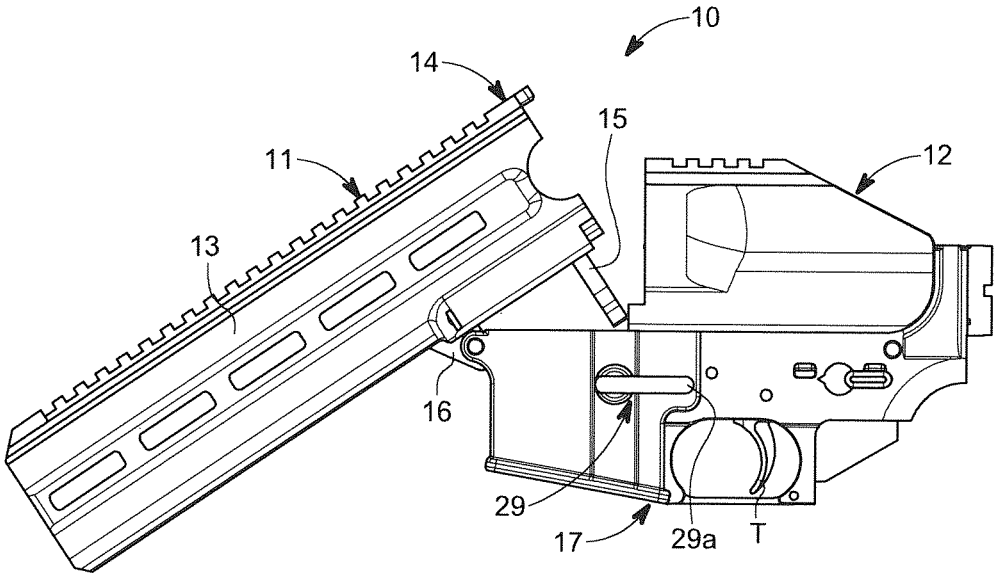
FIG. 5 is a front elevational view of the grenade launcher attachment in breach barrel open position mounted on the lower receiver with portions broken away.

The standard AR15 magazine release assembly 29 provides a spring urged arm 29A that is registerable with the released shoulder 15A. The magazine release assembly 29 is depressed, thereby releasing the barrel latch release fitting 15 allowing the barrel 13 to pivot to an open position as seen in FIG. 5 of the drawings for loading and ejection of an individual projectile round, not shown.

It will be seen that a versatile operator configured launcher system 10 of the invention provides for the assembly of an independent grenade launcher on an AR15 lower receiver assembly 17 configuration employing the use of proven dependable and widely available AR15 trigger assembly 28 and magazine release assembly 29 configurations. The launcher 10 of the invention provides a projectile grenade launcher configuration characterized by a launcher body and barrel assembly to be engaged, supported and interact with an AR15 lower receiver configuration 17 thus providing the unique ability to form a projectile grenade launcher configuration 10 on the lower receiver 17 of a standard AR15 or utilization of just the lower receiver of an AR15 improving its adaptability and performance in the field.

It will thus be seen that a new and novel projectile launcher for an AR15 frame configuration has been illustrated and described and it will be apparent to those skilled in the art that various changes and modifications may be made therein without departing from the spirit of the invention.

Therefore, I claim:

1. A projectile launching attachment for a firearm comprising, a barrel assembly and a firing pin assembly registerably engaged with a lower receiver assembly of a firearm, said barrel assembly pivotally secured to the lower receiver assembly in longitudinal alignment with said firing pin assembly defining a cartridge loading and ejection barrel breach when so engaged therewith, said firing pin assembly comprises a firing pin arm, with a firing pin extension thereon, a spring urged cocking arm and hammer engagement pin movable for select registration of a receiver hammer extending from said lower receiver assembly from a first position to a secured cocked position.

2. The projectile launching attachment for a firearm set forth in claim 1 wherein said firing pin assembly further comprises, a cocking handle arm pivotally extends from the cocking arm, a handle on said cocking handle arm, said handle slidably disposed through a longitudinal opening in a housing for said firing pin assembly.

3. The projectile launching attachment for a firearm set forth in claim 1 wherein said barrel assembly breach portion has a barrel release latch depending therefrom for engagement with a magazine release in said lower receiver assembly of said firearm.

4. The projectile launching attachment for a firearm set forth in claim 1 wherein said receiver hammer engages the firing pin arm when released by a lower receiver trigger assembly from said cocked position in said lower receiver assembly.

5. The projectile launching attachment for a firearm set forth in claim 1 wherein said firing pin assembly is registerably retained to said lower receiver assembly by apertured mounting lugs and registrations pins there through.

6. The projectile launching attachment for a firearm set forth in claim 1 wherein said firing pin and extension is movable from a first position to a projectile engagement position in said barrel breach portion of said barrel assembly when selectively engaged by said receiver hammer.

* * * * *